US008248339B2

(12) United States Patent
Lomas

(10) Patent No.: US 8,248,339 B2
(45) Date of Patent: Aug. 21, 2012

(54) DISPLAY CONTROLLER AND DISPLAY

(75) Inventor: Daniel Robert Lomas, Wallingford (GB)

(73) Assignee: Sharp Kabushiki Kaisha, Osaka (JP)

( * ) Notice: Subject to any disclaimer, the term of this patent is extended or adjusted under 35 U.S.C. 154(b) by 899 days.

(21) Appl. No.: 12/227,629

(22) PCT Filed: Jun. 8, 2007

(86) PCT No.: PCT/JP2007/062068
§ 371 (c)(1),
(2), (4) Date: Nov. 24, 2008

(87) PCT Pub. No.: WO2007/145302
PCT Pub. Date: Dec. 21, 2007

(65) Prior Publication Data

US 2009/0091524 A1 Apr. 9, 2009

(30) Foreign Application Priority Data

Jun. 13, 2006 (GB) ..... 0611632.1

(51) Int. Cl.
*G09G 3/36* (2006.01)

(52) U.S. Cl. ..... 345/87; 345/89; 345/98; 345/100; 345/204; 345/690

(58) Field of Classification Search ..... 345/87–89, 345/90–100, 204, 690–693
See application file for complete search history.

(56) References Cited

U.S. PATENT DOCUMENTS

| | | | | |
|---|---|---|---|---|
| 6,747,621 | B2 | 6/2004 | Miyake | |
| 6,930,663 | B2 | 8/2005 | Sekiya et al. | |
| 6,937,232 | B2 | 8/2005 | Lin et al. | |
| 7,742,065 | B2 * | 6/2010 | Furihata et al. | 345/690 |
| 2002/0175907 | A1 * | 11/2002 | Sekiya et al. | 345/211 |
| 2002/0196221 | A1 | 12/2002 | Morita | |
| 2003/0128176 | A1 | 7/2003 | Ham | |
| 2004/0090407 | A1 * | 5/2004 | Park et al. | 345/87 |
| 2004/0140985 | A1 | 7/2004 | Liaw | |
| 2005/0243075 | A1 | 11/2005 | Hiraki et al. | |
| 2006/0082602 | A1 | 4/2006 | Shen et al. | |
| 2006/0092110 | A1 | 5/2006 | Park | |
| 2006/0109220 | A1 | 5/2006 | Ham | |
| 2007/0120791 | A1 | 5/2007 | Takahashi | |

FOREIGN PATENT DOCUMENTS

| | | |
|---|---|---|
| JP | 09-081083 | 3/1997 |
| WO | WO 2005/101364 | 10/2005 |

* cited by examiner

*Primary Examiner* — Quan-Zhen Wang
*Assistant Examiner* — Jennifer Nguyen
(74) *Attorney, Agent, or Firm* — Harness, Dickey & Pierce, P.L.C.

(57) ABSTRACT

A display controller is provided for controlling a display device, such as a liquid crystal device, to provide pixel overdrive for improving pixel response time. The controller comprises a threshold detector (2) which sets a flag having fewer bits than each pixel value indicating whether a pixel is in a predetermined range for which overdrive is required. The flags are delayed by a frame period in a suitable storage device (6) which does not store the display pixel data. The flags from the display device (6) are supplied to an overdrive selector (3) together with the current pixel data. When the flag is set, the overdrive selector (3) provides overdrive for the current pixel whereas, when the flag is unset, the current pixel value is used without overdrive.

28 Claims, 10 Drawing Sheets

DISPLAY CONTROLLER AND DISPLAY

TECHNICAL FIELD

The present invention relates to a display controller and to a display including such a display controller. Such a controller and display are particularly suitable for, but not limited to, use in mobile applications, where cost and physical size (for example of a silicon controller chip) are important issues.

BACKGROUND ART

Overdrive techniques for improving the response times of displays such as liquid crystal displays are known. According to such techniques, when a change in the optical state of a pixel is required, a voltage greater than that for producing the desired new state is initially applied to the pixel. This causes the pixel state to change more rapidly than would have been the case if the voltage corresponding to the desired state had been initially applied. After one or more frame periods, the voltage is reduced to that actually required for the desired optical state of the pixel.

An example of this is illustrated in FIGS. 1 and 2 of the accompanying drawings. FIG. 1 is a graph of the response of a pixel of a typical liquid crystal display (LCD) to a desired change in state, together with the ideal response. Before time frame zero, the data for the pixel represented zero corresponding, in the case of a normally black display, to a black pixel of substantially zero luminance. At time zero, the pixel data is changed to 64 corresponding to a desired grey-scale luminance illustrated by the "ideal response" curve and the "destination". The ideal response would be for the pixel immediately to assume the luminance corresponding to the data 64 but, because of the finite and relatively slow liquid crystal response time, the pixel takes more than four frame periods to achieve the desired luminance.

FIG. 2 of the accompanying drawings illustrates the effect of applying overdrive. At time zero, although the desired luminance corresponds to pixel data 64, an overdrive level corresponding to an "overdrive target" of 120 is actually applied to the pixel. This causes the pixel to respond much more rapidly such that its luminance rises to a level much closer to the desired value. For subsequent frames, assuming that the desired pixel state is not changed, the "destination" value of 64 is applied as pixel data and the pixel achieves the desired luminance within approximately two display frame periods. The pixel therefore responds much more quickly and reaches the region of the target value, in this example, in less than half the time required without overdrive.

U.S. Pat. No. 6,747,621 discloses a liquid crystal display which performs this type of overdrive. The display comprises a frame memory which is used for delaying the current display data supplied to the liquid crystal device by one display (frame) period. The display also comprises a reference table memory which is addressed by the current pixel value and the pixel value from the previous frame delayed by the frame memory. The memory contains a look-up table down-loaded from a non-volatile memory for selecting the pixel data or level actually supplied to the liquid crystal device as a function of the current and previous values of the pixel. In the case of 8 bit pixel data, the frame memory has to be large enough to hold a complete frame of display data and the look-up table memory requires 256×256×8 bit capacity in order to perform the correct driving of the display device. Further, a substantial amount of non-volatile memory is required in order to store the look-up table with the overdrive information for each possible pixel transition so as to allow for optimisation during development or assembly.

It may also be necessary to operate the display at a higher than normal supply voltage in order for the appropriate overdrive voltages to be available throughout the possible range of transitions in grey-scale. The use of a higher supply voltage results in higher power consumption of the display and this is generally undesirable but particularly so for mobile application which rely on batteries for their power supply.

U.S. Pat. No. 6,937,232 discloses a similar arrangement but with the "overdrive circuitry" transferred from a display unit to an external unit or personal computer where additional memory is available in order to reduce the cost of the display.

U.S. Pat. No. 6,930,663 discloses a technique for suppressing colour shift at sharp image boundaries by increasing the response time of some pixel colours in order to match the response of the slowest colour pixel when overdrive is applied.

WO 2005/101364 discloses a liquid crystal display which provides overdrive based on the current pixel value and the pixel value in the previous frame. The display also deals with "sticky pixels" which were in a state from which their response time is too slow for conventional overdrive. When such sticky pixels are detected in the previous two frames, a "pretilt" voltage is applied in the previous frame before applying overdrive in the current frame.

US 2004/0090407 discloses a liquid crystal display in which overdrive is provided based on the current value and the pixel value in the previous frame. A flag is set according to whether the pixel value has changed and is used to control overdrive.

DISCLOSURE OF THE INVENTION

According to a first aspect of the invention, there is provided a display controller comprising: a detector for setting a flag, having fewer bits than each pixel value, for each of at least some pixels in each (n−1)th display frame having a value in at least one predetermined range, where n is an integer; a storage device for storing the flags and making the stored flags available with a delay of a display frame period without storing display pixel data of the (n−1)th frame; and an output circuit responsive to the storage device for supplying an overdrive value for each of at least some of the pixels of each nth frame where the flags from the storage device were set in the (n−1)th frame and for supplying an unmodified value for those pixels whose flags from the storage device were unset in the (n−1)th frame.

Each flag may comprise one bit. As an alternative, each flag may comprise a plurality of bits for defining a plurality of flag statuses. As a further alternative, the statuses of the flags of each set containing a plurality of the pixels may be represented by the values of a multiple bit word whose number of bits is a minimum for representing all combinations of flag statuses of the set.

Each overdrive value may be a function of the current pixel value. Each overdrive value may also be a function of the value of the flag in the (n−1)th frame. Each overdrive value may be a function of the sum or product of the current pixel value and a constant. The constant may have the same value for all pixels of a group of adjacent pixels.

Overdrive may be inhibited when the current pixel value is in the at least one predetermined range.

The at least one predetermined range may correspond to a range of display outputs from a darkest value to an intermediate value.

The maximum possible overdrive value may be less than or equal to the maximum possible non-overdriven pixel value.

The detector may comprise a threshold detector for comparing the pixel value with at least one threshold.

The output circuit may comprise a look-up table addressed by the current pixel value.

The storage device may comprise a delaying arrangement for delaying the flags by a display frame period. The delaying arrangement may comprise a frame memory. The frame memory may be arranged to store a static image for display in a static image mode. As an alternative, the frame memory may comprise part of a pixel value frame memory. As another alternative, the delaying arrangement may comprise a shift register.

The delaying arrangement may be arranged to perform data compression of the flags before delaying.

The controller may comprise a temperature sensing arrangement for reducing overdrive with increasing temperature.

The controller may comprise a light sensing arrangement for reducing overdrive with increasing ambient light level.

The controller may comprise a gamma correction arrangement for applying a gamma correction which is distorted in the at least one predetermined range.

The detector may be arranged to set the flag if the values of all of the pixels in a set of adjacent pixels are within the at least one predetermined range.

According to a second aspect of the invention, there is provided a display comprising a controller according to the first aspect of the invention and a display device.

The display may form part of a portable device.

The display device may comprise a liquid crystal device.

The liquid crystal device may comprise a transflective device. The liquid crystal device may be a vertically aligned liquid crystal device.

It is thus possible to provide a display controller and a display which is capable of providing overdrive so as to improve the display response time using substantially less memory than was required for known arrangements. This results in a substantial cost saving and a substantial reduction in physical size so that such display controllers and displays are well-suited to use in mobile devices. In embodiments where overdrive values are embodied in the form of a look-up table, which is pre-loaded from a non-volatile memory, the memory size required to store the look-up table can be substantially reduced. Cost and physical size can again be reduced and the time required to load the contents of the non-volatile memory into the controller during circuit initialisation can also be substantially reduced. It is further possible with many embodiments to avoid the need for supply voltages which are higher than those which would be needed without overdrive capability. In such embodiments, the provision of overdrive capability does not have any substantial impact on power consumption so that, for example, overdrive capability may be provided within portable devices without penalty in terms of battery size or time between charging.

BRIEF DESCRIPTION OF THE DRAWINGS

Like reference numerals refer to like parts throughout the drawings.

BEST MODE FOR CARRYING OUT THE INVENTION

Figure 3:
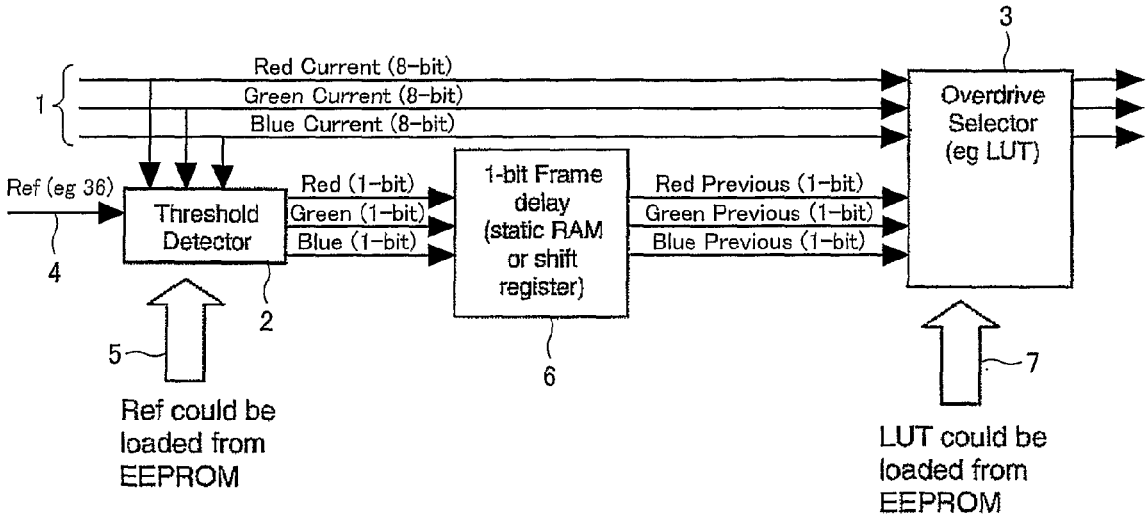
FIG. 3 is a block schematic diagram of a display controller constituting an embodiment of the invention.
Figure 4:
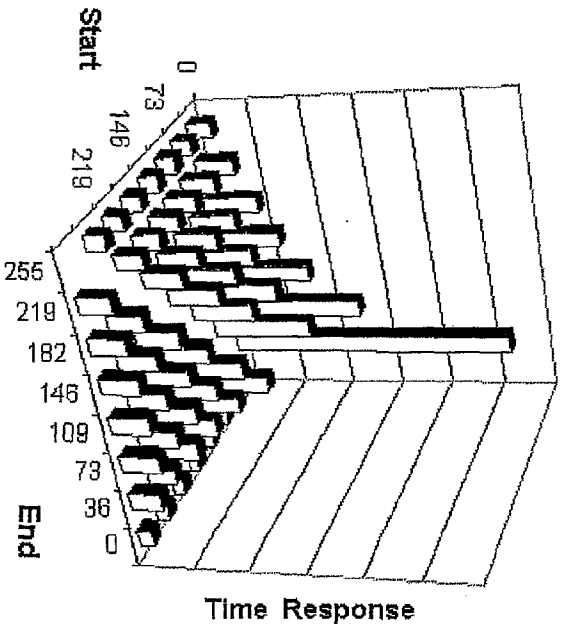
FIG. 4 is a graph of response time against start and end pixel values illustrating the performance of an example of a liquid crystal display device.

The display controller shown in FIG. 3 may be used with any display device where response time is an issue and may lead to undesirable visual artefacts. Display devices employing some types of liquid crystal modes suffer from this issue and, without loss of generality, the following description is based on an application of the controller in a display using a display device based on a vertically aligned liquid crystal mode whose response time performance is illustrated in FIG. 4.

The display controller receives red, green and blue component signals as serial streams of 8 bit words on an input buss 1 and supplies these to a threshold detector 2 and to an overdrive selector 3. The individual colour components are processed separately but in parallel. Each 8 bit colour component pixel data for the currently received pixel is compared by the threshold detector 2 with one or more thresholds so as to establish whether the pixel data is within one or more ranges. In the example illustrated in FIG. 3, each 8 bit word represents a luminance value from zero to 255 and is compared with a reference value 36 representing a relatively dark grey level of luminance. The detector 2 supplies a single bit output for each colour component indicating whether the current pixel data value is less than or equal to the reference value. If this is the case, then the one bit output is set to the value "1". If the pixel data word is greater than the reference value of 36, the one bit output for that colour component is set to the value "0". The reference value may be hard-wired as indicated at 4 or may be loaded, as indicated at 5, from a non-volatile memory such as an electrically erasable programmable read-only memory (EEPROM) which is not shown in FIG. 3. Such a value may therefore be varied or selected during development or even during use and is typically downloaded when a display including the controller is switched on.

The one bit outputs for the colour components are supplied to a frame delay device 6, which passes each one bit value to the corresponding output with a delay equal to a frame period of the display device (not shown) controlled by the controller. The delayed one bit "flags" are supplied to the overdrive selector 3 simultaneously with the current pixel data words for the colour components of the same display device pixel.

The overdrive selector 3 selects the values of the colour component pixel data supplied to the display device as a function of the values of the current colour component words and the flags indicating whether the corresponding word for the pixel one frame earlier was above or below the reference supplied to the threshold detector 2. In this embodiment, overdrive is applied to pixels whose previous value (in the immediately preceding frame) was in the range below and including the reference applied by the threshold detector 2. No overdrive is applied to pixels whose previous values were above the threshold so that, for such pixels, the current colour component pixel data are forwarded to the output of the selector 3 without change.

The overdrive selector 3 effectively applies a function to the pixel data of those pixels which are to be overdriven. The selector 3 may, for example, be in the form of a look-up table which may, for example, be loaded from the EEPROM on switch-on of the display as illustrated at 7. Alternatively, the selector 3 may be arranged to perform an arithmetic function so as to provide overdrive.

The device 6 may be of any type suitable for providing a one frame period delay to the input bits. For example, the device 6 may comprise a frame memory embodied as static random access memory (RAM) of sufficient length and with the appropriate addressing to provide the one frame period delay. As an alternative, the device 6 may comprise a shift register of the appropriate length and clocked at the appropriate clock frequency to provide the one frame period delay.

The display controller is arranged to make use of three properties in order to improve response time by means of pixel overdrive without the need for relatively large memories or relatively high overdrive voltages. The human eye is only capable of noticing slow pixel response times if the start and end luminance levels of a change in pixel luminance level are significantly different from each other. Thus, if the current and previous pixel levels differ by a relatively small amount, then it is unnecessary to provide overdrive for such a transition because the visual artefacts produced by the display device will not be apparent to a viewer.

In general, the pixel response time is unacceptably slow for a relatively small number of transitions grouped in one region or possibly a few discrete regions. An example of this is illustrated in FIG. 4 for a normally black vertical alignment display device. The response time in milliseconds of transitions between previous and current data values is illustrated with transitions involving relatively small luminance changes being omitted. For this type of display device, unacceptably slow response times occur when changing from a black or near black state to a mid to dark grey state.

It is also frequently the case that response times change only gradually with changes in the "start" pixel grey level. Thus, transitions which are adjacent each other in the graph shown in FIG. 4 and which require overdrive can be provided with the same amount of overdrive. For example, a transition from a previous or start pixel value of zero to a current or end value of 64 requires substantially the same amount of overdrive as a transition from a start value of 1 to an end value of 64.

The embodiment of FIG. 3 makes use of all of these properties so as to provide overdrive to a relatively small number of "worse case transitions" where both a slow response time is present and a large luminance change is required. In this case, the only information required of the previous pixel data values is whether such a value in the previous frame was "near-black" or not. The threshold detector 2 effectively converts the full resolution pixel data into a one bit flag for each colour component providing this information.

Figure 5:
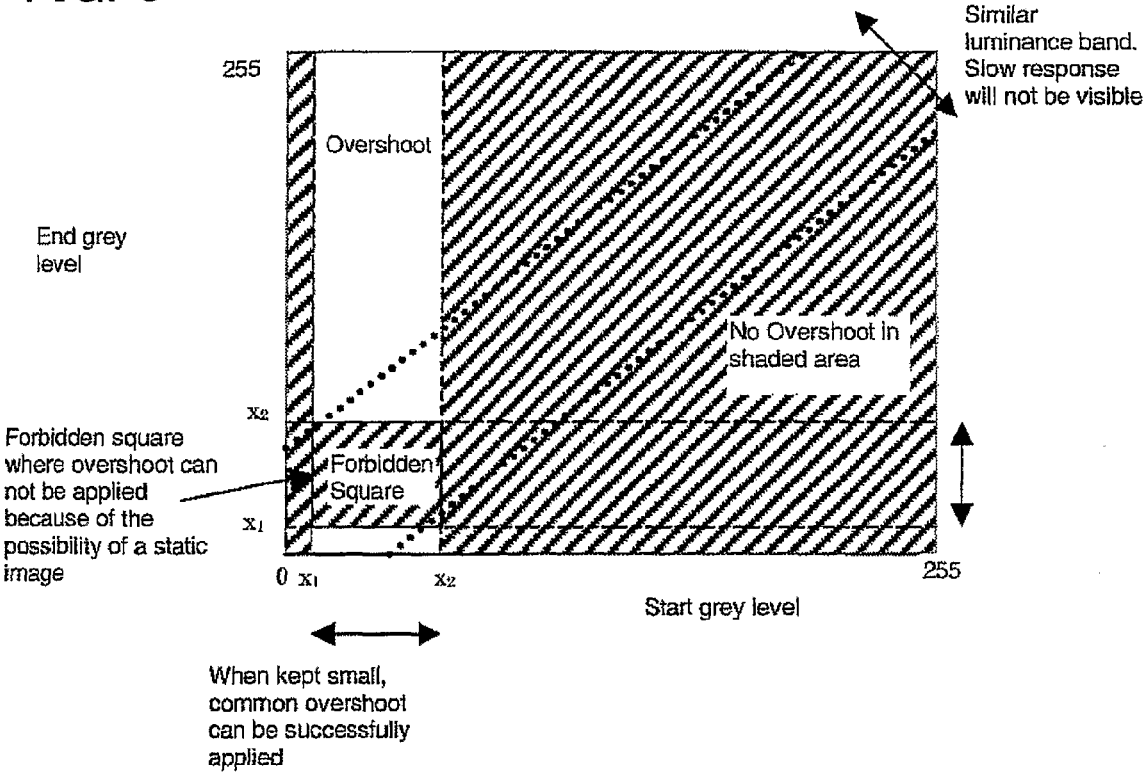
FIG. 5 is a graph illustrating the range over which overdrive may be applied.

FIG. 5 is a graph of end grey levels against start grey levels illustrating the regions in this "space" where overdrive is provided. Overdrive is only required where the start grey level is between $x_1$ and $x_2$ as determined by the response times of the liquid crystal display device. No overdrive may be provided where the end grey level is also in the range between $x_1$ and $x_2$ in order to avoid undesirable artefacts. In particular, because the exact value of the start grey level is not known when the current pixel data are being processed if the current pixel data are also within this range, then it may be that the pixel is required to display the same grey level as in the previous frame. If overdrive were applied in this situation, this would result in undesirable image flicker becoming visible. Thus, in the case of the controller shown in FIG. 3, although the flags supplied to the overdrive selector 3 may indicate that the start grey level is in a region where overdrive may be applied, the selector 3 is arranged not to provide any overdrive where the current or end grey level is in the same range. This is illustrated as the "forbidden square" in FIG. 5. In any case, because the human eye is substantially insensitive to relatively small luminance changes as illustrated by the diagonal band in FIG. 5, this problem can be completely avoided without any loss of performance because the forbidden square is positioned within the diagonal band where slow response times are not visible.

Figure 6:
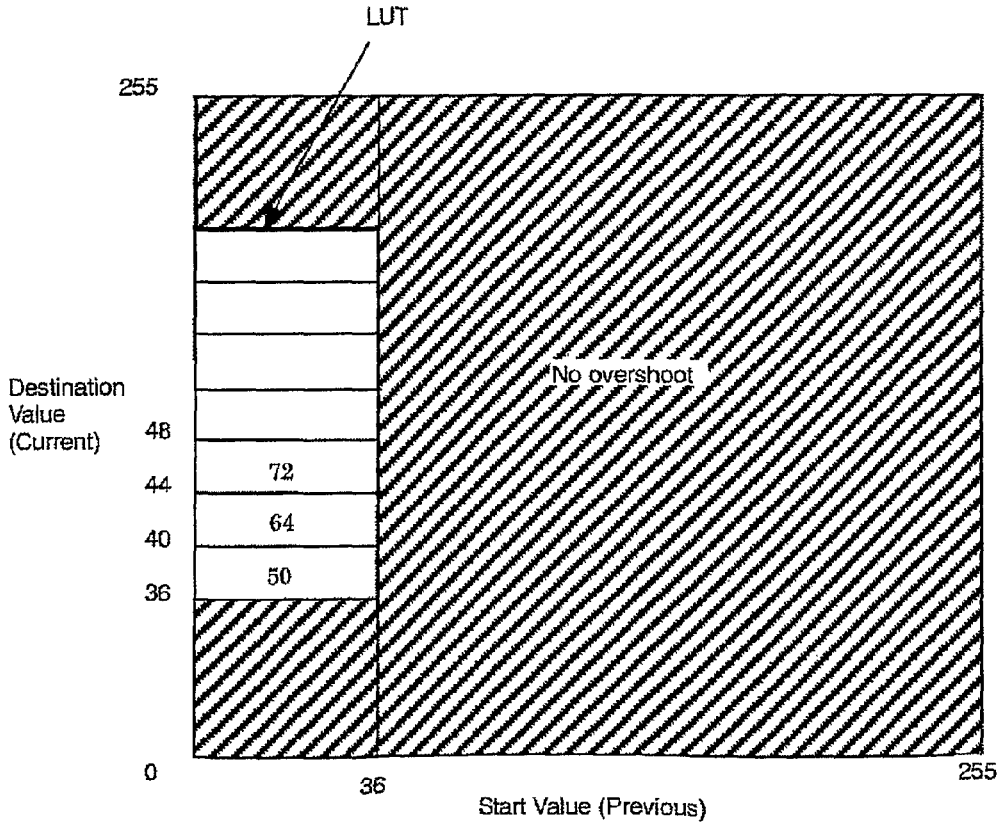
FIG. 6 is a diagram illustrating an example of a look-up table for providing overdrive.

In the case of the embodiment shown in FIG. 3 where the threshold detector 2 compares the pixel values with a single threshold, use is made of the property that response times change relatively gradually with start pixel grey-scale so as to simplify the overdrive selection. For example, FIG. 6 illustrates look-up table values for a typical example so that the same overdrive "target" is provided for each end grey level or "destination value" irrespective of the start value within the overdrive range. This feature is also used to simplify the look-up table in that the same overdrive value is used for destination values which are close together. For example, an overdrive value of 50 is used for destination values between 36 and 40 and this is irrespective of the actual start value.

Although the overdrive is applied for the single frame in which a grey level translation takes place in the embodiment illustrated in FIG. 3, it would also be possible to apply overdrive for more than one frame period if necessary or desirable to provide an acceptable response time. For example, a further frame delay device could be connected to the output of the device 6 and its outputs also supplied to the selector 3.

The threshold detector 2 and the overdrive selector 3 may be arranged to provide overdrive in any appropriate region of the graph shown in FIG. 5. Thus, the controller may be arranged for use with any liquid crystal or other display technology to improve the response times of pixel luminance transitions in order to provide acceptable display performance. In other words, the start grey levels $x_1$ and $x_2$ defining the "overdrive range" may be of any desired value with the forbidden square being defined by these values and with relatively small changes in luminance being omitted as desired from overdrive.

In the example illustrated in FIG. 3, the size of the device 6, such as a frame memory, is greatly reduced as compared, for example, with a conventional overdrive scheme which requires the whole word of each pixel from the previous frame to be made available. In this specific example, a 24 bit word frame memory may thus be replaced by a three bit word frame memory so that the memory size is reduced to one eighth of that which would previously have been required.

Further, the previous technique required a look-up table with entries for all combinations of the values of the current pixels and the values of the previous pixels. The embodiment shown in FIG. 3 requires a much smaller look-up table which, in turn, reduces the required size of the EEPROM for non-volatile storage of the look-up table. This substantially reduces the time required to load the contents of the look-up table at switch-on or "circuit initialisation" of the controller. Substantial reductions in cost and physical size are achieved so that the controller is well-suited to use in mobile devices.

With previously known overdrive arrangements, it was commonplace for overdrive pixel voltages to be greater than the maximum non-overdriven pixel voltage so that substantially higher supply voltages had to be provided. This in turn lead to relatively high power consumption. By using the techniques illustrated in FIGS. 3 to 6, for many liquid crystal and other display technologies, the overdrive is applied only where necessary and this may allow the use of overdrive voltages which do not exceed the non-overdrive voltages or which exceed the non-overdrive voltages by less than for the known types of controllers. In such cases, power consumption can be substantially reduced, for example to provide prolonged battery life and/or to avoid the need for larger capacity batteries in mobile devices.

Figure 1:
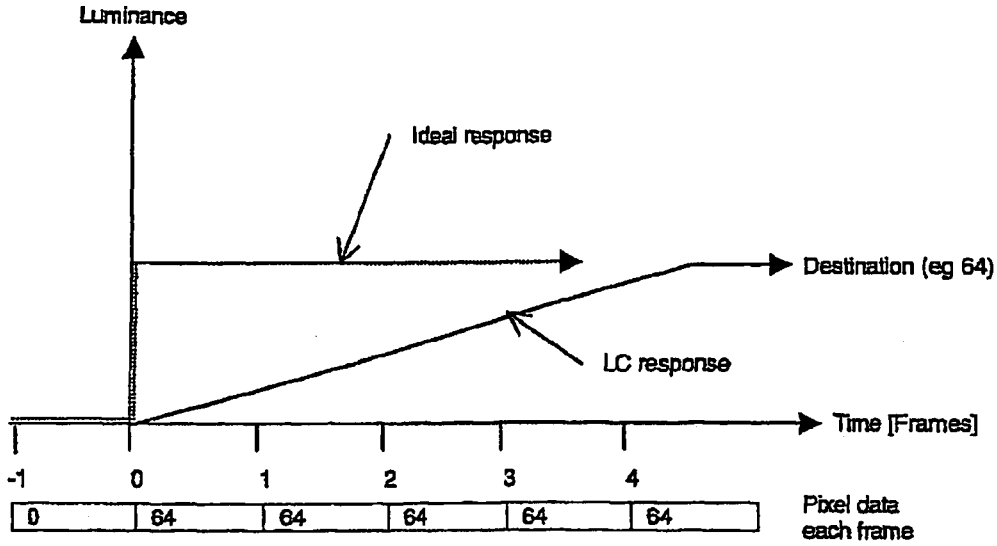
FIG. 1 Prior Art
FIG. 1 is a graph illustrating a conventional liquid crystal driving technique and response time.
Figure 2:
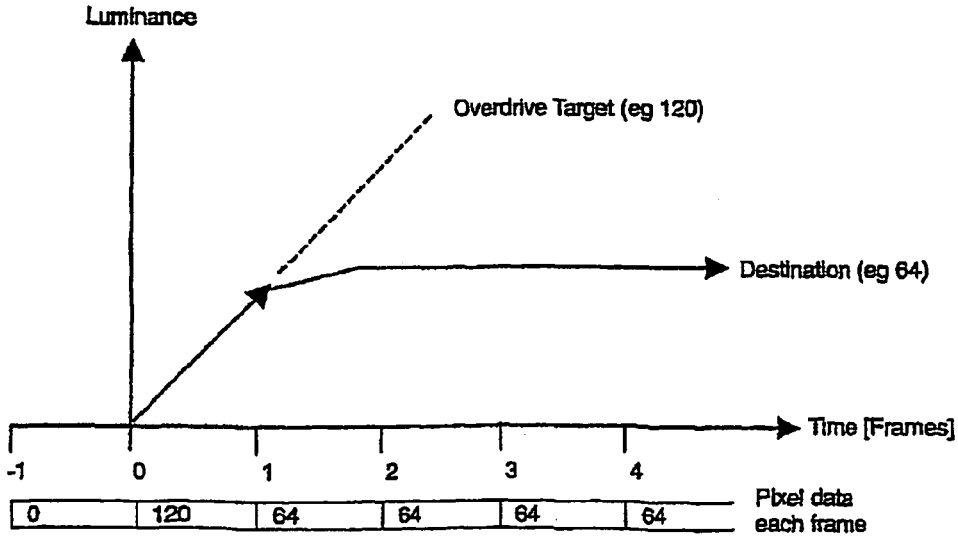
FIG. 2 Prior Art
FIG. 2 is a graph illustrating another known liquid crystal driving technique and response time making use of overdrive.
Figure 7:
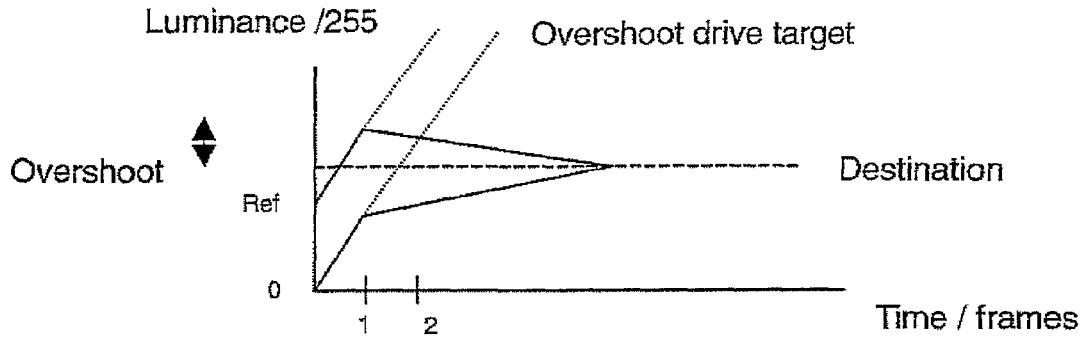
FIG. 7 is a graph of response times illustrating an optimisation technique for the controller.

Because the same "amount" of overdrive is provided, within the overdrive region, for each destination value from a range of start values, the actual amount of overdrive represents a compromise which must be acceptable for luminance transitions from all of the start values. This is permissible because the required overdrive does not change quickly with start value for each destination value or small set of adjacent destination values, as illustrated in FIG. 6. The controller may be optimised in terms of overdrive selection by monitoring transitions from the highest and lowest start values of the overdrive region to each destination value and applying a varying level of overdrive until an acceptable or optimum compromise is reached between excessive overshoot and insufficient overdrive. FIG. 7 is a graph similar to FIG. 2 illustrating pixel performance for the two extreme start values with an optimum compromise overdrive value having been selected so as to minimise overshoot at one extreme and insufficient overdrive at the other extreme.

Figure 8:
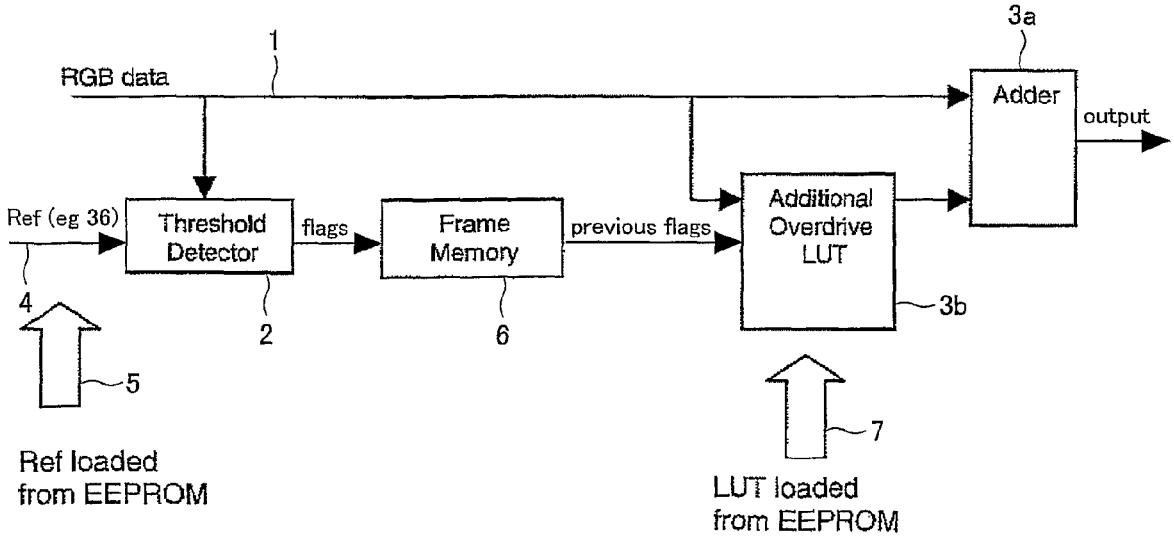
FIG. 8 is a block schematic diagram of a display controller constituting another embodiment of the invention.
Figure 9:
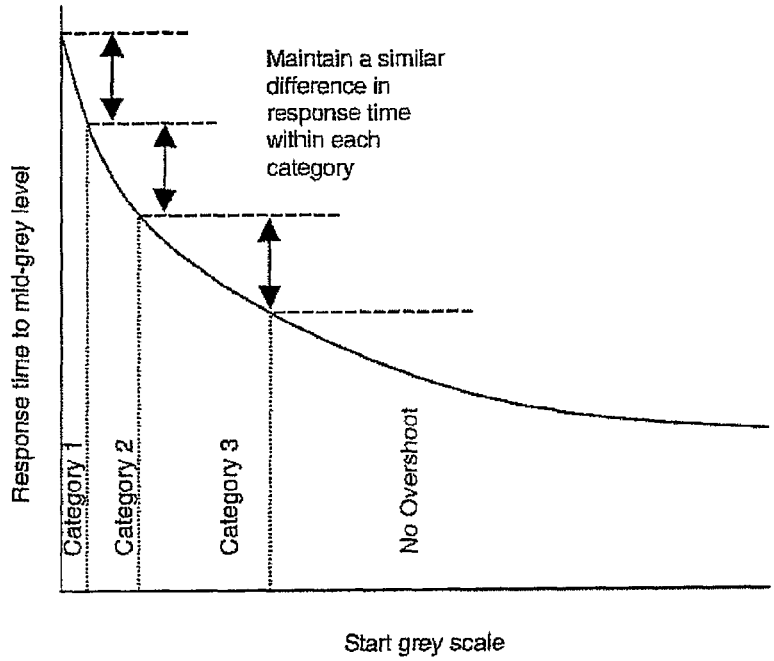
FIG. 9 is a graph illustrating response time against start level for a characteristic with large response time variations.

FIG. 8 illustrates another embodiment of the display controller differing from that shown in FIG. 3 in that the overdrive selector 3 is embodied as an adder 3*a* and an additional overdrive look-up table (LUT) 3*b*. The LUT thus contains values which are to be added to the basic pixel value in order to provide overdrive and these "increases" in pixel value are added to the basic value in the adder 3*a*. The table 3*b* is addressed by the current RGB data on the buss 1 and the RGB flags supplied by the frame memory 6.

Where the overdrive region is too large and/or the response time and hence the required overdrive change too rapidly for a single overdrive value to provide adequate performance for each destination value irrespective of the start value within the overdrive region, the overdrive region may be divided into several regions or sub-regions in order to allow acceptable performance to be achieved. For example, FIG. 9 illustrates the pixel response time of an example of a liquid crystal display device when switching to a mid-grey level from a range of start grey levels. The technique illustrated in FIG. 6 does not provide a sufficient improvement in response time while avoiding visible overshoot artefacts because the response time changes relatively quickly with the start grey level.

In order to provide acceptable performance with such a display device, the overdrive region is divided into three regions covering similar ranges of response times to provide categories 1, 2 and 3 as illustrated in FIG. 9. In order to embody this technique, the controller shown in FIG. 3 is modified such that the threshold detector 2 compares the current pixel values with three threshold or reference levels to determine the "category" to which the current colour component pixel belongs and encodes this as a two bit flag for each colour component. The frame store or shift register 6 has to be larger in order to provide a delay of one frame period for the six bits (two bits for each colour component) from the detector 2. Similarly, the look-up table in the selector 3 and the EEPROM from which it is loaded have to be of larger size to provide the overdrive value look-up tables for the three categories. It may be desirable to define category 1 to be a single value of fully saturated black so as to provide optimum performance for graphic applications where fully saturated colours are often present.

Figure 10:
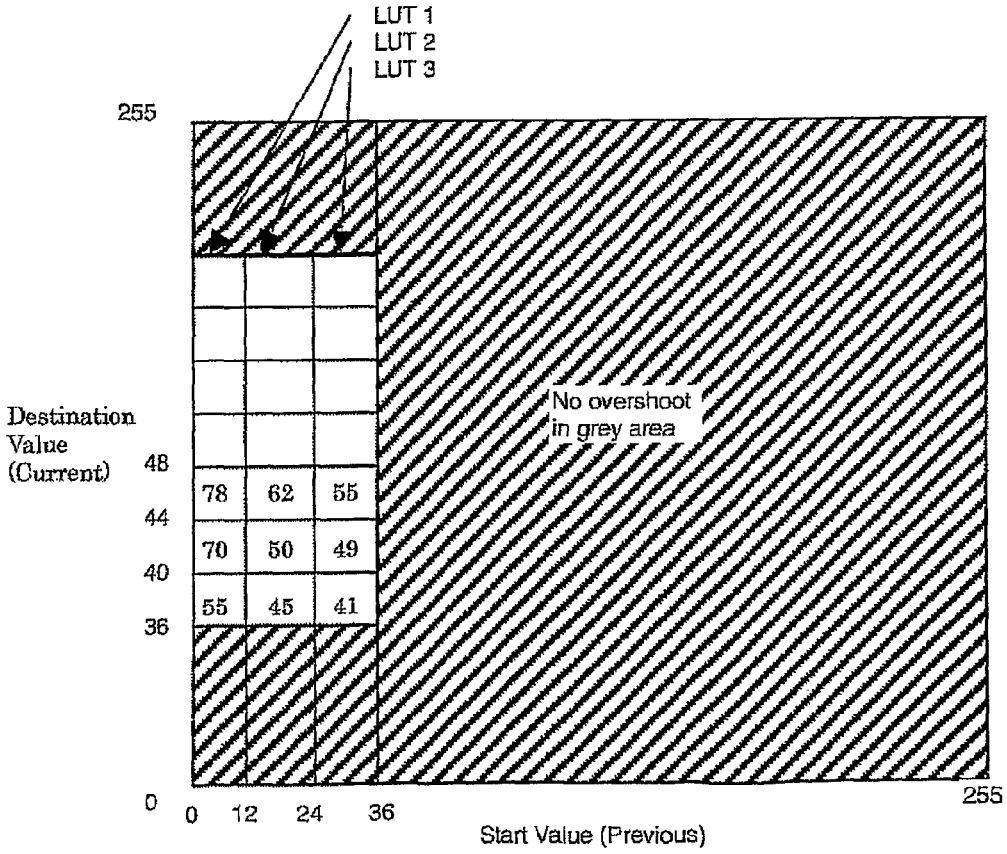
FIG. 10 is a diagram similar to FIG. 6 illustrating look-up tables for a plurality of start ranges.

FIG. 10 illustrates a specific example of a look-up table comprising three sub-tables LUT1-LUT3 for different start value ranges. In this case, the LUT1 provides overdrive values where the flag indicates that the start value is in the range from zero to 12, the LUT2 provides overdrive values for the start value range 12 to 24, and the LUT 3 supplies overdrive values for start values between 24 and 36.

The improvement in performance is achieved at the expense of more reference values, more look-up tables and an increase in the size of the device 6. However, it is generally possible for an acceptable performance to be achieved where the number of bits in each flag is substantially less than the number of bits for each pixel data word so that acceptable overdrive may be achieved together with a reduction in size and cost.

A reduction in bit requirements may be achieved by encoding the categories for a number of pixels as a combined word. For example, the three colour component pixels forming a composite colour pixel may be processed together. In order to define three categories for each colour component pixel, 27 possible combinations have to be encoded. A five bit word can encode 32 combinations and is therefore sufficient to encode the 27 combinations for the colour component pixels. The threshold detector 2 thus defines the categories of the three colour component pixels as specific combinations of the five bits and the "composite five bit flag" is supplied to the device 6 and from the device 6 to the selector 3. The "size" of the device 6 may therefore be reduced by approximately 17%.

Figure 11:
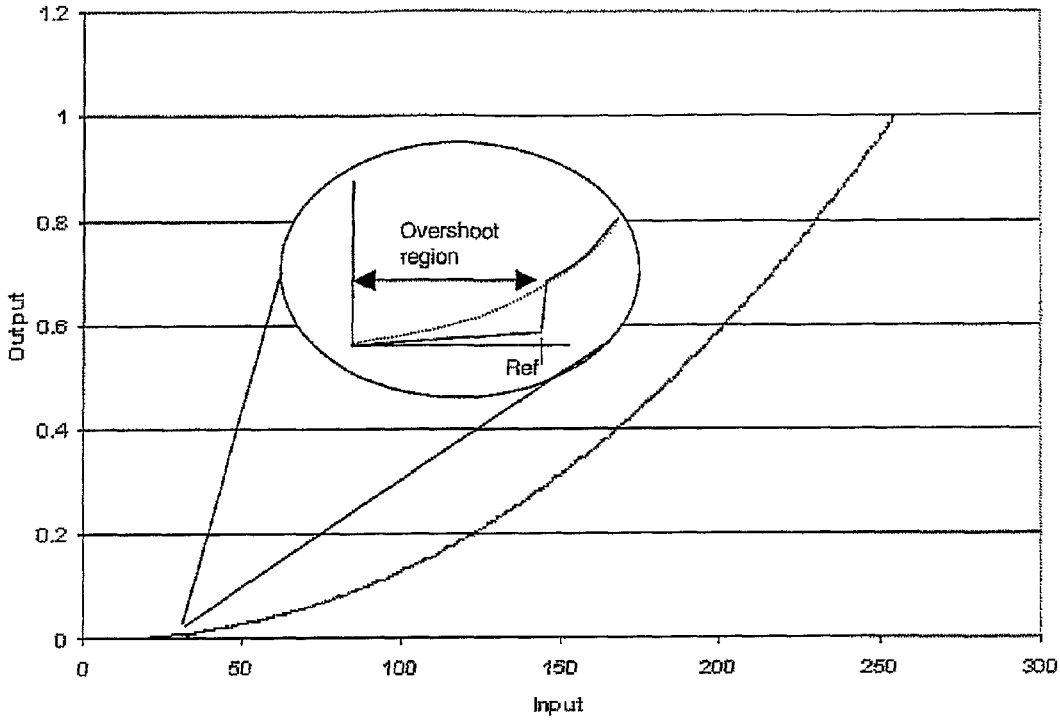
FIG. 11 is a graph illustrating a gamma curve and a modification to such a curve for use in an embodiment of the invention.

As is well known, the transfer function between the voltage supplied to a display pixel and the resulting optical output such as luminance is non-linear and this is generally corrected by a technique known as "gamma correction". FIG. 11 illustrates a typical gamma correction curve in arbitrary units for a typical liquid crystal device pixel. This function is applied to the pixel data values supplied to the display device in order to provide the desired linear response of optical effect, such as luminance, to pixel data value.

In order to reduce the variation in pixel response time over the overdrive region, the gamma curve may be modified as shown in the inset in FIG. 11. This modification allows a higher level of overdrive or "overshoot" to be applied without causing excessive overdrive for higher luminance start values within the overdrive region. This technique maintains the same number of displayable colours and the same contrast ratio while improving the effectiveness of the overdrive.

The two extreme conditions are now closer together in terms of luminance and therefore have more similar response times. It should therefore be easier to find an acceptable optimum compromise in overdrive value for use across the overdrive range. This results in some distortion of the image grey level performance but the effect may be substantially imperceptible.

Figure 12:
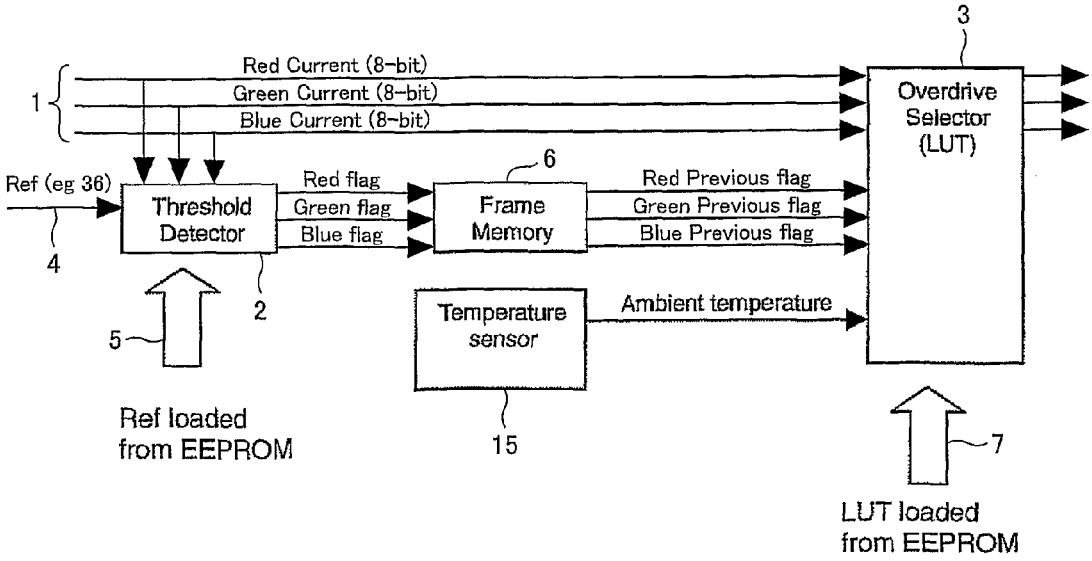
FIGS. 12 and 13 are block schematic diagrams of display controllers constituting further embodiments of the invention.

FIG. 12 illustrates a display controller which differs from that shown in FIG. 3 in that a temperature sensor 15 is provided for sensing the ambient temperature and hence provides a measure of the liquid crystal temperature of the display device. An ambient temperature signal is supplied to the selector 3 for modifying the overdrive values in accordance with the sensed temperature.

It is known that the response time of, for example, liquid crystal devices varies with temperature. In general, the response time is faster for higher temperatures so that the overdrive level may be varied according to temperature and may even be switched off for relatively high temperatures. Acceptable performance may therefore be achieved over a greater range of ambient temperatures.

Figure 13:
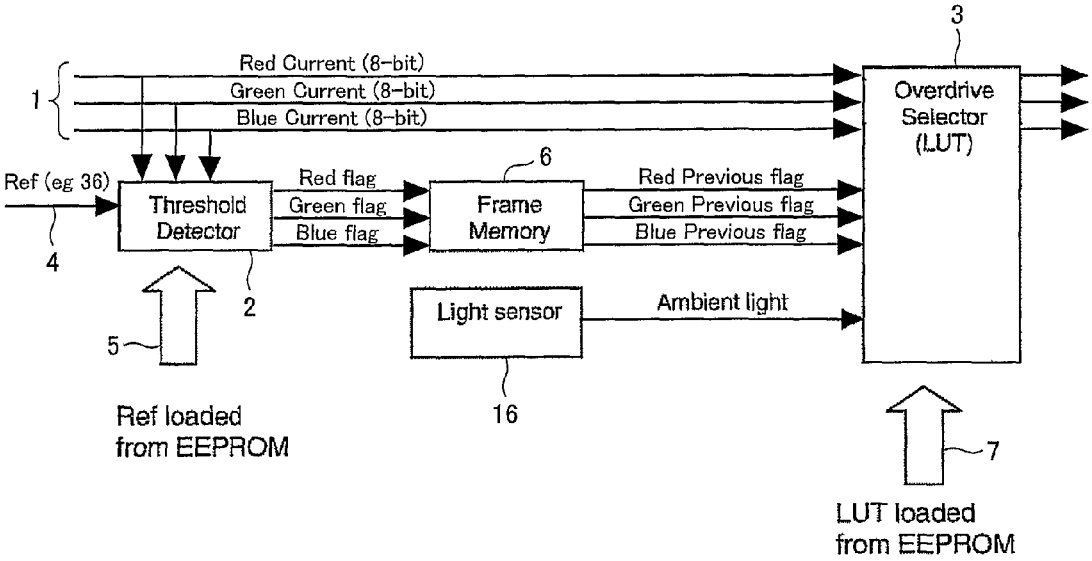

The controller shown in FIG. 13 differs from that shown in FIG. 3 in that a light sensor 16 is provided and supplies a signal to the overdrive selector 3 representing the level of ambient light. Such a controller is particularly suitable for use with transflective display devices where each pixel has a reflective portion having a narrower cell gap than for the transmissive portion so that the reflective portion has a faster response time than the transmissive portion. In relatively bright ambient light conditions, such as in bright sunlight, the luminance provided by the reflective portion becomes more dominant and excessive overshoot may become visible. By using a measure of the ambient lighting level to vary the overdrive and/or switch off the overdrive for relatively bright ambient light, the range of ambient lighting conditions over which the display may provide acceptable performance may be substantially increased.

In the previously described embodiments, a flag is provided for every display pixel and is used to determine whether, and possibly how much, overdrive is supplied during a subsequent frame for the respective pixel. However, for many images, there is a relatively low spatial content frequency over most of the image so that the luminance (for each colour) changes gradually across the image. It may therefore be acceptable, in at least some applications, to divide the display device pixels into groups of adjacent pixels and to provide a single flag for each group. For example, in the case of a single bit flag, the flag may be set to actuate overdrive only if all of the pixels in the group fall within the overdrive range. For example, flags may be provided for alternate pixels in alternate lines of an image so as to reduce the memory size of the device 6 by a factor of four. Such an arrangement may provide acceptable performance in some applications with artefacts being visible at an acceptably low level.

Figure 14:
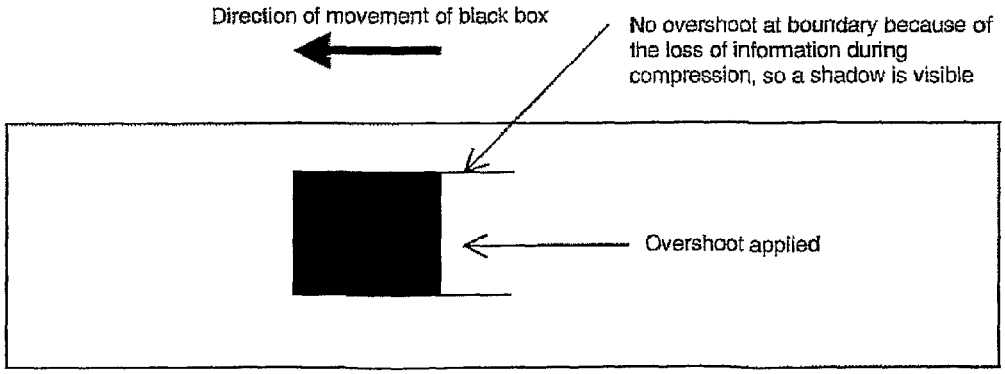
FIG. 14 is a diagram illustrating a visual artefact which may occur with a display.

FIG. 14 illustrates such visible artefacts in the case where a displayed black "box" is moving across the display device screen to the left. In this case, shadows in the form of horizontal lines extending from the upper and lower edges of the box and behind it may be temporally displayed and may be visible. This results from overdrive not being applied to some pixels which should receive overdrive.

The reduced number of flags may be combined with multiple category overdrive as described hereinbefore and such an arrangement may include a circuit for storing an average value so that, at a boundary point, one pixel will have too much overdrive whereas an adjacent pixel will have too little overdrive. For a display device of sufficiently high spatial resolution, the effect is to average out the total luminance so that any shadowing of the type shown in FIG. 14 becomes imperceptible.

When used in devices which already contain a frame memory, part of the frame memory may be used as the device 6 if reduced colour depth is acceptable. For example, FIG. 15 illustrates a frame memory arrangement of a device whose display operation may be switched between a static image mode and a moving image or video mode.

Figure 15:
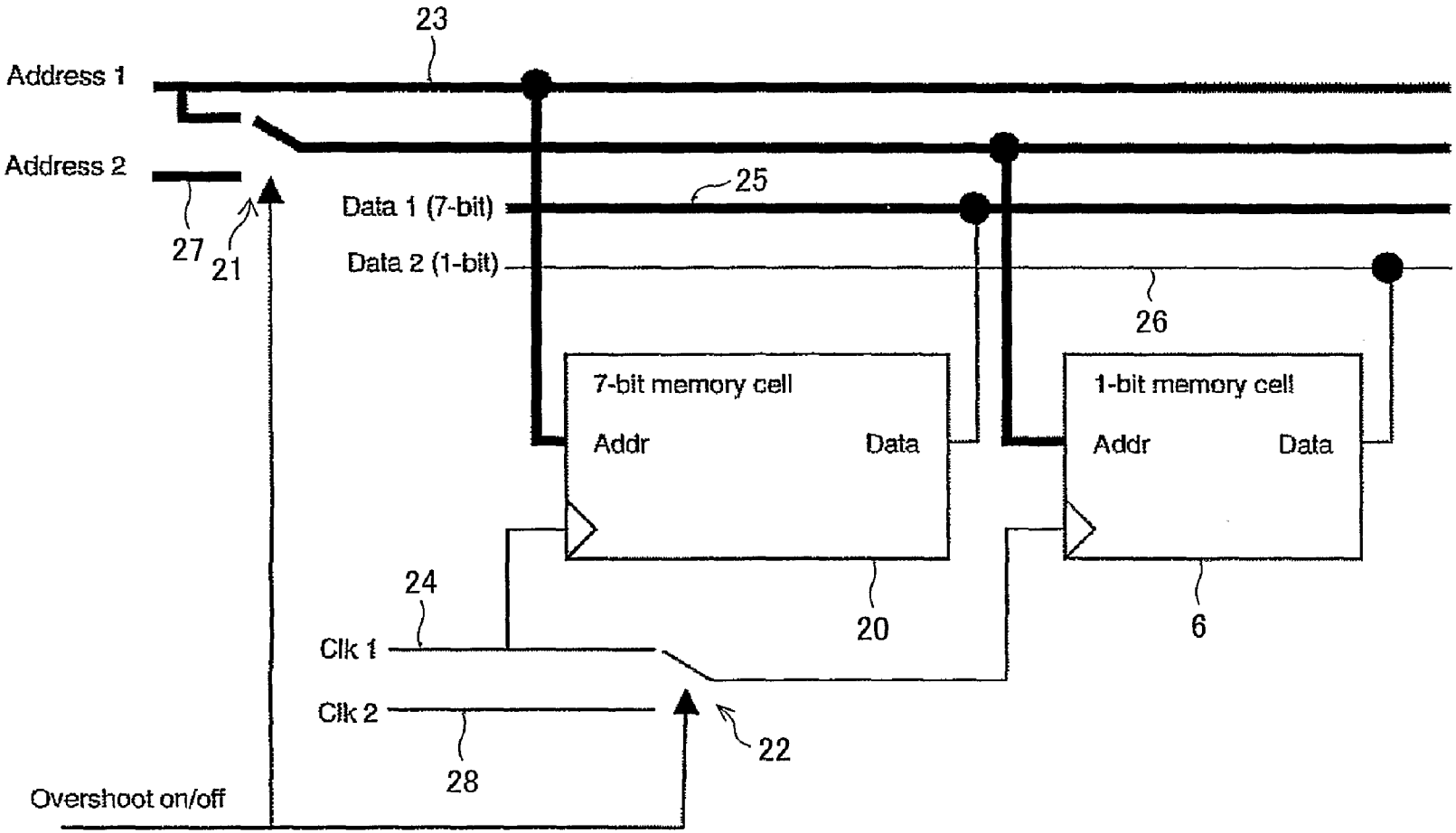
FIGS. 15 to 18 are block schematic diagrams illustrating display controllers constituting yet further embodiments of the invention.

The frame memory shown in FIG. 15 comprises a first "7 bit wide" portion 20 and a second "1 bit wide" portion forming the device 6. These are typically triplicated for the three colour components. Addressing and clocking of the memory portions are controlled by an "overshoot on/off" signal which controls electronic changeover switches 21 and 22. The 7 bit memory portion 20 has address inputs connected to a first address buss 23 and a clock input connected to a first clock line 24. The data input/output of the portion 20 is connected to a 7 bit data buss 25. The data input/output of the memory portion 6 is connected to a one bit data buss 26. The address input of the memory portion 6 is connected to the switch 21 for connection to the address buss 23 or to another address buss 27. The memory portion 6 has a clock input connected to the clock line 24 or to a further clock line 28 by the switch 22.

When overdrive operation is not required, for example when a static image is to be displayed, the switches 21 and 22 connect the address inputs and the clock input of the memory portion 6 to the address buss 23 and the clock line 24, respectively. Full colour depth operation is therefore available for this mode of operation.

When overdrive is required, the switches 21 and 22 connect the address and clock inputs of the memory portion 6 to the address buss 27 and the clock line 28, respectively, so that the memory portion 6 functions as the device for delaying flags by a frame period. In this mode of operation, the flags are supplied to the memory portion 6 by the data buss 26. The memory portion 20 receives pixel data from the buss 25 with 7 bit resolution so that reduced colour depth operation is provided in this mode. Thus, for a device including such a reconfigurable frame memory, overdrive may be provided without requiring substantial additional hardware to embody the device 6.

Figure 16:
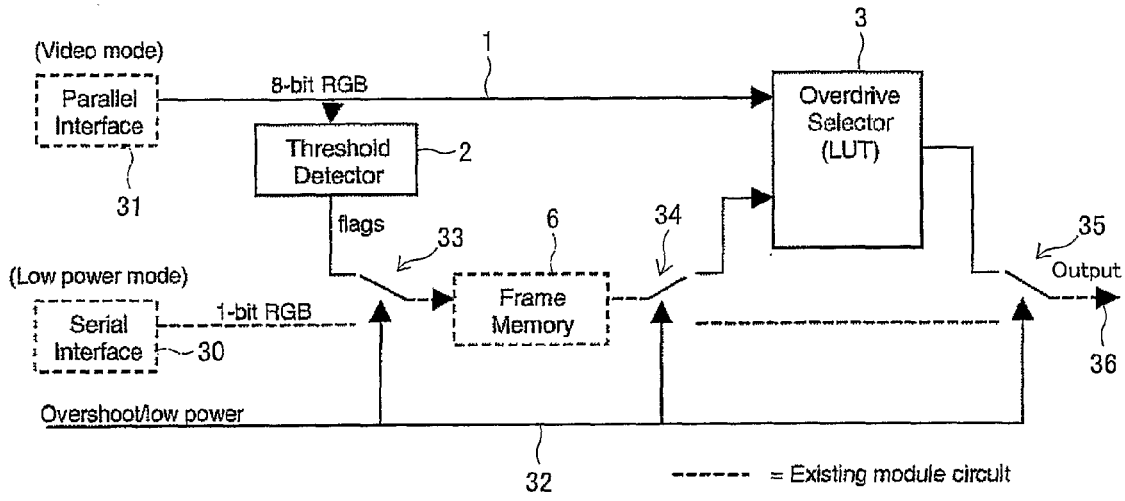

FIG. 16 illustrates another existing type of display which may be modified so as to include the embodiment shown in FIG. 3 using an existing frame memory 6 of the display for providing overdrive. The display has a partial frame memory 6 which is 1 bit wide and is used, for example, only in power saving modes to display a static image from a serial interface 30. The display also has a parallel interface 31 which is used during video modes to display moving images with full colour depths. An "overshoot/low power" control line 32 controls the operation of electronic switches 33-35, which may for example be embodied as multiplexers.

During the low power mode of operation, the serial interface is connected to the input of the frame memory 6, whose output is connected to the output 36 of the controller for supplying image data to the display device (not shown). During video modes of operation, the switch 33 connects the input of the frame memory 6 to the output of the threshold detector 2 to receive the flags, the switch 34 connects the output of the frame memory to an input of the overdrive selector 3, and the switch 35 connects the output of the selector to the controller output 36. The controller thus operates as described hereinbefore for the embodiment of FIG. 3.

Figure 17:
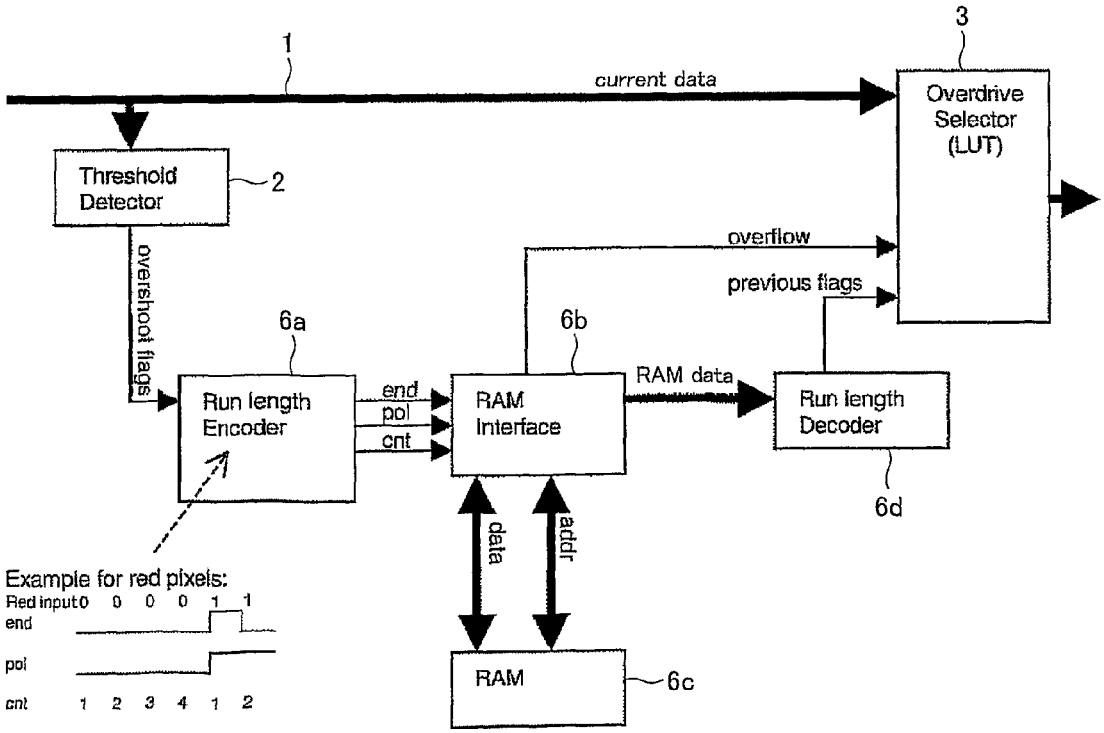

FIG. 17 illustrates a further embodiment which makes use of run length encoding so as to reduce memory space requirements. The embodiment of FIG. 17 differs from that of FIG.

3 in that the device 6 is embodied as a run length encoder 6*a*, a RAM interface 6*b*, a RAM 6*c* and a run length decoder 6*d*.

This embodiment makes use of the fact that, when the red, green and blue colour components are considered separately, a large proportion of images produce a flag data stream comprising long strings of zeros and long strings of ones. The stream of flags is supplied to the run length encoder 6*a*, which encodes it by setting the signal "pol" to be equal to the first bit of a string and then counting successive identical bits until the data changes. When the bit value changes, the signal "end" goes high, which causes the interface 6*b* to store the value of the signal "pol" followed by the number of bits indicated by the count signal "cnt". This process is repeated for each string of bits of the same value.

The entries stored in the RAM 6*c* are retrieved so that each flag is made available simultaneously with the corresponding pixel data for the current pixel being supplied to the selector 3. The run length decoder 6*d* performs the appropriate decoding function by creating a sequence of serial data using the signal "pol" to set the first bit of a data stream and repeating the bit value while counting down from the count "cnt" until it reaches zero. The run length encoding and decoding is performed for each of the colour components in parallel.

It is possible for the capacity of the RAM 6*c* to be exceeded during operation, for example when processing a checker image, so that the interface 6*b* stops writing to the RAM 6*c*. A frame later, when the read address reaches the end of the RAM, an overflow flag is set and supplied to the selector 3, which then stops providing overdrive for the remainder of the frame. The overflow flag is then reset by a vertical synchronisation signal to indicate the beginning of a new frame.

Figure 18:
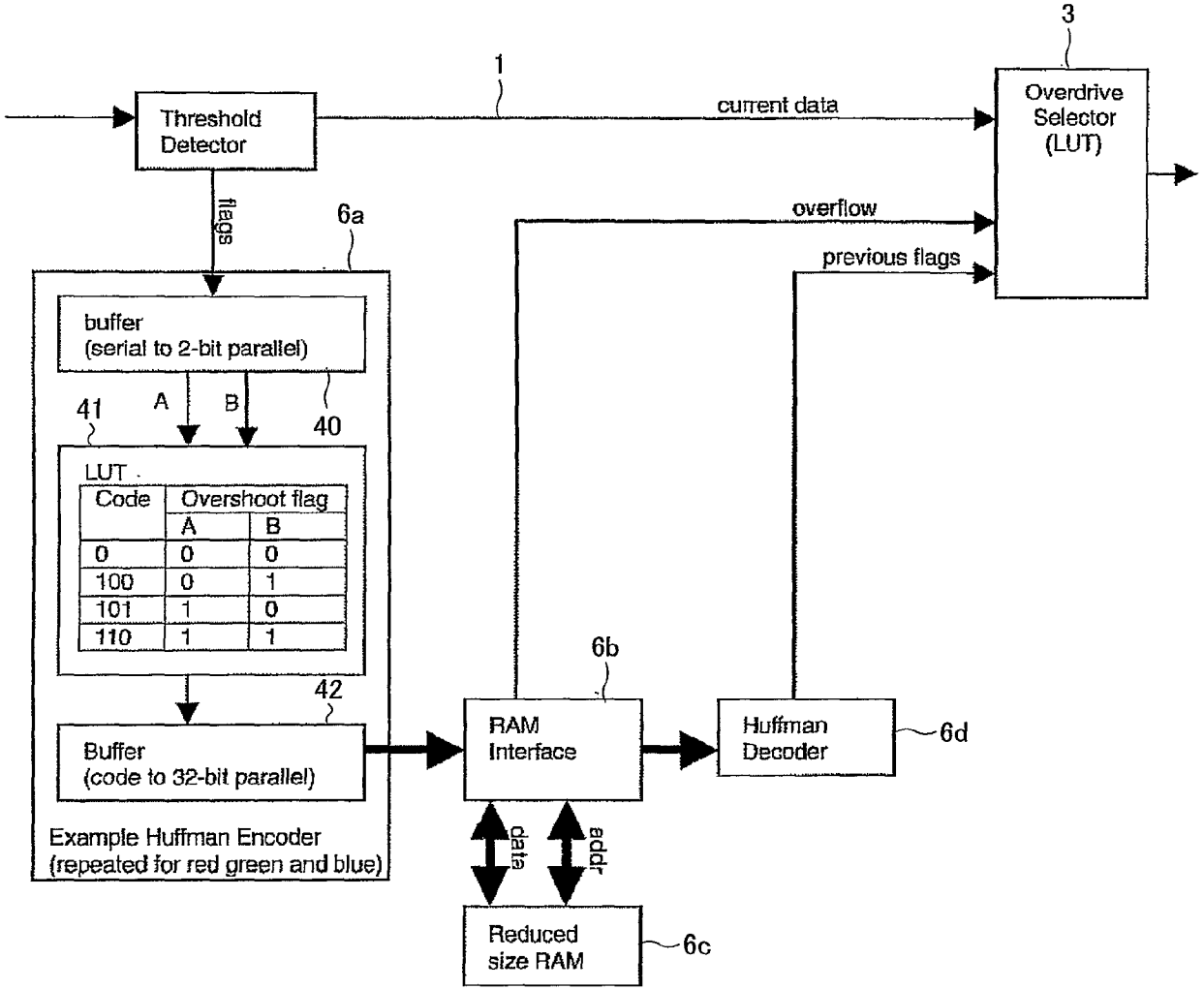

FIG. 18 illustrates a display controller which differs from that shown in FIG. 17 in that the encoder 6*a* and the decoder 6*d* are arranged to perform Huffman encoding and decoding, respectively. Huffmann coding uses shorter length codes for more common symbols in order to provide data compression. Slow response times are most visible when the background is mid-grey and a dark object moves across it. Such an image will therefore contain only a small number of dark pixels because the background has to be mostly grey. By using a short code, such as a single "0", for flagging "no overdrive" and longer codes for describing overdrive categories where overdrive needs to be applied, the memory requirement within the device may be substantially reduced.

In the example illustrated in FIG. 18, the encoder 6*a* comprises a buffer 40, a look-up table 41 and a buffer 42. Again, the arrangement shown in FIG. 18 is provided for each colour component in parallel.

In this example, the buffer 40 performs serial to two bit parallel conversion and the resulting bits A and B are supplied to the look-up table 41 as address inputs. The "no overdrive" is the most common condition so that this is given the shortest code, namely zero. The other possible combinations of the two bits are encoded by respective sequences of three bits. The output of the table 41 is supplied to a buffer 42, which converts the code to 32 bit parallel code, which is stored in the memory 6*c* via the interface 6*b*. The data are then retrieved and decoded by the decoder 6*d* so as to provide the one frame delay period for each flag.

The size of the memory 6*c* may thus be reduced but the smaller the memory the fewer the number of dark pixels that may be stored before it overflows. In this example, reducing the memory size by 20% allows the controller to cope with all images having more than 70% of pixels above the threshold in accordance with the following:

$$\text{RAM size} = 70\% \text{ no overdrive} + 30\% \text{ overdrive}$$

$$\text{RAM size} = \left(\frac{1 \text{ bit}}{2 \text{ sub-pixels}} \times 0.7\right) + \left(\frac{3 \text{ bits}}{2 \text{ sub-pixels}} \times 0.3\right) = 0.8 \text{ bits/sub-pixel}$$

If larger codes are used to describe larger numbers of pixels, then it is possible to provide further compression so as to reduce the required memory size. The optimum code length depends on the type of data being displayed and varies for different display resolutions and for different display applications. If the displayed image is mostly black and the RAM is filled, the interface 6*b* stops writing to the memory 6*c*. Again, during the next frame when the memory address reaches the end of the memory, an overflow flag is set and stops the overdrive selector 3 from applying overdrive for the remainder of the frame. The overflow flag may again be reset by a frame synchronisation pulse.

As illustrated in FIGS. 6 and 10, common overdrive values may be used for groups of adjacent destination values so that a single value need only be stored for each group with appropriate decoding so as to reduce the size of the look-up table. Alternatively or additionally, piecewise linear techniques may be used to interpolate between the stored values so as to provide improved overdrive performance.

The invention claimed is:

1. A display controller comprising: a detector for setting a flag, having fewer bits than each pixel value, for each of at least some pixels in each (n−1)th display frame, having a value in at least one predetermined range, where n is an integer; a storage device for storing the flags and making the stored flags available with a delay of a display frame period without storing display pixel data of the (n−1)th frame; and an output circuit responsive to the storage device for supplying an overdrive value for each of at least some of the pixels of each nth frame where the flags from the storage device were set in the (n−1)th frame and for supplying an unmodified value for those pixels whose flags from the storage device were unset in the (n−1)th frame.

2. A controller as claimed in claim 1, in which each flag comprises one bit.

3. A controller as claimed in claim 1, in which each flag comprises a plurality of bits for defining a plurality of flag statuses.

4. A controller as claimed in claim 1, in which the statuses of the flags of each set comprising a plurality of the pixels are represented by the values of a multiple bit word whose number of bits is a minimum for representing all combinations of flag statuses of the set.

5. A controller as claimed in claim 1, in which each overdrive value is a function of the current pixel value.

6. A controller as claimed in claim 5, in which each overdrive value is also a function of the value of the flag in the (n−1)th frame.

7. A controller as claimed in claim 5, in which each overdrive value is a function of the sum or product of the current pixel value and a constant.

8. A controller as claimed in claim 7, in which the constant has the same value for all pixels of a group of adjacent pixels.

9. A controller as claimed in claim 1, in which overdrive is inhibited when the current pixel value is in the at least one predetermined range.

10. A controller as claimed in claim 1, in which the at least one predetermined range corresponds to a range of display outputs from a darkest value to an intermediate value.

11. A controller as claimed in claim 1, in which the maximum possible overdrive value is less than or equal to the maximum possible non-overdriven pixel value.

12. A controller as claimed in claim 1, in which the detector comprises a threshold detector for comparing the pixel value with at least one threshold.

13. A controller as claimed in claim 1, in which the output circuit comprises a look-up table addressed by the current pixel value.

14. A controller as claimed in claim 1, in which the storage device comprises a delaying arrangement for delaying the flags by a display frame period.

15. A controller as claimed in claim 14, in which the delaying arrangement comprises a frame memory.

16. A controller as claimed in claim 15, in which the frame memory is arranged to store a static image for display in a static image mode.

17. A controller as claimed in claim 15, in which the frame memory comprises part of a pixel value frame memory.

18. A controller as claimed in claim 14, in which the delaying arrangement comprises a shift register.

19. A controller as claimed in claim 14, in which the delaying arrangement is arranged to perform data compression of the flags before delaying.

20. A controller as claimed in claim 1, comprising a temperature sensing arrangement for reducing overdrive with increasing temperature.

21. A controller as claimed in claim 1, comprising a light sensing arrangement for reducing overdrive with increasing ambient light level.

22. A controller as claimed in claim 1, comprising a gamma correction arrangement for applying a gamma correction which is distorted in the at least one predetermined range.

23. A controller as claimed in claim 1, in which the detector is arranged to set the flag if the values of all of the pixels in a set of adjacent pixels are within the at least one predetermined range.

24. A display comprising a controller as claimed in claim 1 and a display device.

25. A display as claimed in claim 24, forming part of a portable device.

26. A display as claimed in claim 24, in which the display device comprises a liquid crystal device.

27. A display as claimed in claim 26, in which the liquid crystal device comprises a transflective device and the controller comprises a light sensing arrangement for reducing overdrive with increasing ambient light level.

28. A display as claimed in claim 26, in which the liquid crystal device is a vertically aligned liquid crystal device.

* * * * *